US010226071B2

(12) United States Patent
Nagel

(10) Patent No.: US 10,226,071 B2
(45) Date of Patent: Mar. 12, 2019

(54) APPARATUS FOR SECURING TO THE TOP OF A BOTTLE OR CANISTER FOR PROVIDING A SMOKING ASSEMBLY

(71) Applicant: William Leland Nagel, Denver, CO (US)

(72) Inventor: William Leland Nagel, Denver, CO (US)

( * ) Notice: Subject to any disclaimer, the term of this patent is extended or adjusted under 35 U.S.C. 154(b) by 2 days.

(21) Appl. No.: 15/680,047

(22) Filed: Aug. 17, 2017

(65) Prior Publication Data

US 2018/0049468 A1 Feb. 22, 2018

Related U.S. Application Data

(60) Provisional application No. 62/376,250, filed on Aug. 17, 2016.

(51) Int. Cl.

| | |
|---|---|
| ***A24F 47/00*** | (2006.01) |
| ***A24F 7/02*** | (2006.01) |
| ***A24F 1/02*** | (2006.01) |
| ***A24F 1/30*** | (2006.01) |

(52) U.S. Cl.

CPC ..... *A24F 7/02* (2013.01); *A24F 1/02* (2013.01); *A24F 1/30* (2013.01)

(58) Field of Classification Search

USPC ..... 131/328, 329

See application file for complete search history.

(56) References Cited

U.S. PATENT DOCUMENTS

| | | | | |
|---|---|---|---|---|
| 2017/0251717 | A1* | 9/2017 | Mehio | A24F 1/30 |
| 2017/0325498 | A1* | 11/2017 | Goldstein | A24F 1/30 |
| 2018/0000137 | A1* | 1/2018 | Passe | C12N 1/06 |

OTHER PUBLICATIONS

Poke N Smoke Instant Waterpipe Kit, https://www.amazon.com/Poke-Smoke-Instant-Waterpipe-Kit/dp/B0009ESGRM.
Poke N Smoke, https://www.youtube.com/watch?v=7d83FmYT67o.
Water Puff, https://www.youtube.com/watch?v=7fMP7dmJpfA.
Water Puff, https://www.youtube.com/watch?v=GwJnlYpoxc4&t=74s.

* cited by examiner

*Primary Examiner* — Phuong K Dinh
(74) *Attorney, Agent, or Firm* — Lewis Brisbois Bisgaard & Smith LLP; Ian R. Walsworth

(57) ABSTRACT

The present disclosure provides a smoking apparatus and assembly that may be used with a variety of standard sized bottles, and which comprises a non-toxic, easily cleaned or disposable straw and bowl. The present disclosure allows a person to utilize common, recyclable and/or natural materials to inhale cooled/filtered smoke from burnt plant leaves in a conservative and efficient manner.

20 Claims, 6 Drawing Sheets

APPARATUS FOR SECURING TO THE TOP OF A BOTTLE OR CANISTER FOR PROVIDING A SMOKING ASSEMBLY

CROSS-REFERENCE TO RELATED APPLICATION

This application claims the benefit of U.S. Provisional Application No. 62/376,250, filed on Aug. 17, 2016, which is hereby incorporated by reference herein for all purposes.

FIELD OF THE INVENTION

The present disclosure relates to a device for use in a smoking apparatus or assembly. The present disclosure also relates to methods of manufacturing and/or using the apparatus and assembly described herein.

BACKGROUND OF THE INVENTION

The earliest record of smoking dates back to 3000 B.C. Smoking leaves, such as tobacco, may take several forms, including but not limited to dried, cured, and natural forms of a particular leaf or leaves, being smoked in a pipe or other vessel, or other methods known by those of ordinary skill in the art. Presently, the more popular ways of smoking dried leaves include: (1) rolling leaves in paper to create a cigarette; (2) reusing a glass/metal/ceramic pipe; and (3) reusing a larger glass water pipe or bong.

Each of the methods described above suffers from multiple disadvantages. Rolled leaves, such as with cigarettes, are difficult to prepare and may result in lost leaf product, and further result in lost smoke into the atmosphere during smoking, including between each inhalation. Additionally, the smoke from the burning and/or burnt leaves may be inhaled into the lungs at hot temperatures, especially as the cigarette becomes shorter from burning of the paper and leaves into ash. And finally, debris from plant leaves can be inhaled, leading to additional health concerns, if an appropriate filter is not included, which is not often provided.

As is the case with rolled products, when using a pipe, the smoke from the burnt leaves can be inhaled at hot temperatures, depending on the size of the pipe. Also, since pipes are reusable, if the pipe is not properly cleaned after every use then the user can inhale previously burnt carcinogens along with the new burnt plant leaves, leading to additional health concerns. Further, smoke from pipes is often wasted into the atmosphere between inhalations, and undesirable debris and/or residue from plant leaves may be inhaled through the pipe when there is no substantial filter.

Water-based pipes and bongs suffer from other disadvantages. For example, larger water pipes/bongs can be quite expensive, and some are easily broken requiring undesired replacement costs. Such pipes/bongs are also typically larger in size, are difficult to transport, and are inconvenient when in transit as they do not typically fit into a pocket or purse or the like. Additionally, like with a standard pipe, if the water pipe/bong is not properly cleaned after every use, the user may inhale previously burnt carcinogens.

Accordingly, there is a need for an apparatus that decreases the time for assembly with standard and non-standard sized vessels, enhances the methods of manufacturing and/or using the same, and which otherwise overcomes the disadvantages of the prior art. Given the downfalls described in the preceding paragraphs, it is further desirable to provide a new and improved manner of smoking plant leaves, which is cleaner, results in less waste, and otherwise mitigates the disadvantages described above in relation to the more popular methods of smoking. There is also a present and long-felt need for use of more natural, recyclable and/or reusable materials for such apparatus and assemblies, which may incorporate the natural cooling/filtering process provided from water. Furthermore, there is a present need for an apparatus and assembly that may be used with a common and/or standard sized glass bottle or with non-standard bottle types as well as other vessels, which incorporates a non-toxic, easily cleaned or in certain embodiments disposable straw, so that the user can easily use the apparatus and assembly to smoke plant leaves more cleanly and more efficiently and without the need to provide or carry additional apparatus.

Other advantages over the prior art will become known upon review of the Summary and Detailed Description provided below.

BRIEF SUMMARY OF THE INVENTION

The present disclosure comprises, in a preferred embodiment, an apparatus and assembly that may be used with a variety of standard sized bottles, and which comprises a non-toxic, easily cleaned or disposable straw and bowl. The present disclosure allows a person to utilize common, recyclable and/or natural materials to inhale cooled/filtered smoke from burnt plant leaves in a conservative and efficient manner.

In embodiments described herein, an apparatus is comprised generally of a concave bowl, which preferably comprises a partially-perforated bottom portion, a side wall and "straw" element extending from the bowl. The straw element provides a channel or cannula for placing a disposable (or in certain embodiments, non-disposable) straw there. The straw element may be sized to accommodate a variety of different sized and shaped straws, including a slightly tapered straw to create a tight fit in the channel. In a preferred embodiment, the straw element comprises a generally vertical slit to allow expansion and contraction of the straw element and the bowl to accommodate different sized vessels.

According to one embodiment, the apparatus comprises a generally concave bowl configured to be received by an opening of a vessel, the generally concave bowl comprising an open top surface, a side wall, and a perforated bottom portion, a substantially hollow element that protrudes from the open top of the bowl and above the opening of the vessel, the apparatus further comprising a slit extending vertically along a length of the substantially hollow element and at least a portion of the bowl, wherein the slit accommodates expansion or contraction of the apparatus to at least temporarily secure the apparatus to the vessel opening, and wherein the substantially hollow element is configured to receive a straw there.

According to another embodiment, the substantially hollow element is offset from a vertical centerline of the apparatus, and wherein the substantially hollow element extends away from the centerline at angle $\Theta$ from the vertical axis of the bowl, and wherein angle $\Theta$ is approximately 20-40 degrees. In a most preferred embodiment, the angle $\Theta$ is approximately 30 degrees.

According to other embodiments, the vessel is a bottle comprised of material that can be easily cleaned, re-used or recycled. In other embodiments, the vessel is filled with water or other liquid at least to a certain desired volume, but no less than 10% of the entire volume of the vessel. In yet other embodiments, the vessel is filled with water or other liquid by approximately 33% of the entire volume of the vessel.

According to certain embodiments, the water or other liquid added to the vessel ranges in temperature from about 45 degrees to about 70 degrees Fahrenheit.

According to other embodiments, a method for smoking leaves with the apparatus is disclosed, which in a preferred embodiment comprises the steps of:

filling a vessel to approximately ⅓ of the total volume with cold water;

engaging a smoking apparatus with the top of the vessel with a straw element facing upward;

inserting a flame-resistant and non-toxic straw into the straw element and down into the interior of the vessel;

positioning the straw relative to the straw element to ensure that ample material extends beyond the apparatus so that the top end of the straw may be placed on the lips of the user without the face of the user coming into close contact with the bowl, such that any flame or heated leaf material is at a safe distance from the user's face;

placing crushed plant leaves into the bowl for lighting with a fire instigating device; and smoking the crushed plant leaves by lighting the plant leaves with a fire instigation device, wherein the user places his or her lips on the top end of the straw, wherein the smoke from the burnt leaves travels down in to the open air chamber of the vessel and up through the straw while being cooled by the water and the ambient temperature of the vessel, wherein excess debris from the burnt leaves is filtered down into the water portion of the vessel by falling directly through apertures located on the bottom of the smoking apparatus, and wherein cooled and filtered smoke from the burnt leaves is trapped in the open air chamber of the vessel thus conserving it from going up into the atmosphere and for further enjoyment by the user.

In one embodiment, the smoke is cooled by water in the bottle and inhaled using a non-toxic, flame-resistant straw, which is used with the assembly. The bowl is designed so that excess smoke is temporarily trapped in the bottle to reduce waste.

Another advantage of the present disclosure is the use of one or more natural, recyclable and/or reusable materials for manufacturing the apparatus and assemblies, which may incorporate such natural processes as the cooling/filtering process provided from water in either a distilled or non-distilled state.

One having skill in the art will appreciate that embodiments of the present disclosure may have various sizes, or be used in conjunction with bottles or canisters having different sizes, or various sized openings. The sizes of the various elements of embodiments of the present disclosure may be sized based on various factors including, for example, the dimensions of the bottle or canister, the dimensions of the bowl and/or straw, the volume of water desired in the bottle or canister, the preferences of the person using the apparatus and/or assembly, the physical features of the apparatus and/or bottle or canister, and the amount of leaves desired for placing in the smoking apparatus during use as a smoking device.

Embodiments of the present disclosure present several advantages over the prior art including, for example, the speed and efficacy of the use of the apparatus versus prior art apparatus, the portability of the apparatus, the flexibility of the apparatus to be used with a variety of standard sized bottles, canisters and other fluid reservoirs, the disposability of the apparatus, the benefits to the environment and the health of the user of the apparatus, the ability to customize the apparatus for use by a particular individual user, and the ability to clean and/or sterilize the apparatus, among other benefits.

One having skill in the art will appreciate that embodiments of the present disclosure may be constructed of materials known to provide, or predictably manufactured to provide the various aspects of the present disclosure. These materials may include, for example, stainless steel, titanium alloy, aluminum alloy, chromium alloy, and other metals or metal alloys. These materials may also include, for example, carbon fiber, ABS plastic, polyurethane, polyethylene, photo-polymers, resins, particularly fiber-encased resinous materials rubber, latex, synthetic rubber, synthetic materials, polymers, and natural materials.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being approximations which may be modified in all instances as required for a particular application of the novel apparatus described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

The terms "leaf", "leaves", and "leaf product," and variations thereof, as used herein, are intended to be used interchangeably, and include any known biologic leaf/leaves, flower(s), and bud(s).

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

The Summary is neither intended, nor should it be construed, as being representative of the full extent and scope of the present disclosure. Moreover, references made herein to "the present disclosure" or aspects thereof should be understood to mean certain embodiments of the present disclosure, and should not necessarily be construed as limiting all embodiments to a particular description. The present disclosure is set forth in various levels of detail in the Summary as well as in the attached drawings and the Detailed Description, and no limitation as to the scope of the present disclosure is intended by either the inclusion or non-inclusion of elements or components when describing certain embodiments herein. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

In the drawings:

FIG. 1 is a front elevation view of the apparatus according to one particular embodiment of the present disclosure;

FIG. 2 is a rear elevation view of the apparatus of FIG. 1;

FIG. 3 is a side elevation view of the apparatus of FIG. 1;

FIG. 4 is a top perspective view of the apparatus of FIG. 1;

FIG. 5 is a top plan view of the apparatus of FIG. 1;

FIG. 6 is a bottom perspective view of the apparatus of FIG. 1;

FIG. 7 is a detailed view of the apparatus of FIG. 1 shown in relation to a bottle and straw;

FIG. 8 is another view of the apparatus, bottle and straw of FIG. 7;

FIG. 9 is a detailed view of a second embodiment of the present disclosure shown in relation to a bottle and straw that comprises a U-shape at the lower portion of the straw; and FIG. 10 describes a method for smoking crushed leaves with the smoking apparatus depicted in FIGS. 1-9.

DETAILED DESCRIPTION OF THE INVENTION

The present disclosure has significant benefits across a broad spectrum of endeavors. It is the Applicant's intent that this specification and the claims appended hereto be accorded a breadth in keeping with the scope and spirit of the disclosure and various embodiments disclosed, despite what might appear to be limiting language imposed by specific examples disclosed in the specifications. To acquaint persons skilled in the pertinent arts most closely related to the present disclosure, preferred and/or exemplary embodiments are described in detail without attempting to describe all of the various forms and modifications in which the novel apparatus, devices, systems and methods might be embodied. As such, the embodiments described herein are illustrative, and as will become apparent to those skilled in the arts, may be modified in numerous ways within the spirit of the disclosure.

The appended drawing figures and descriptions thereof provide embodiments only, and are not intended to limit the scope, applicability, or configuration of the claimed invention. Rather, the ensuing detailed description will provide those skilled in the art with an enabling description for implementing the embodiments. It should be understood that various changes may be made in the function and arrangement of elements without departing from the spirit and scope of the claimed invention.

Figure 1:
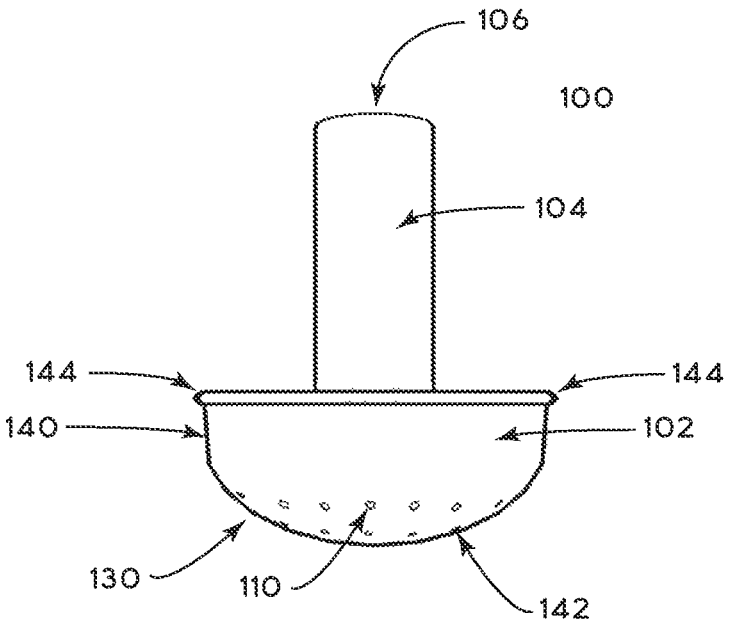

Embodiments of the present disclosure are depicted in FIGS. 1-10. Referring now to FIG. 1, a front elevation view of the smoking apparatus 100 according to one embodiment is shown. The apparatus 100 is comprised of a concave bowl 102, comprising a perforated bottom portion 142, a side wall 140 and generally cylindrical "straw" element 104 extending from the bowl 102, as shown in FIG. 1. The straw element 104 is not the actual straw 108 used for smoking with the apparatus 100, but rather provides a channel or cannula 106 for placing a disposable (or in certain embodiments, non-disposable) straw 108 therethrough. The generally cylindrical straw element 104 may be sized to accommodate a variety of different sized straws 108, and in some embodiments is not cylindrical and is instead shaped to accommodate different sized and shaped straws and their equivalents.

The bowl 102 of the apparatus 100 in a preferred embodiment may comprise a series of perforations or apertures 110 in a lower portion 130 of the bowl 102, as depicted in FIG. 1, which forms a perforated bottom portion 142 of the bowl 102. These apertures 110 may vary in size depending on a number of factors, including but not limited to the relative size of the leaves (not shown) to be placed in the bowl 102, the relative surface area of the bowl 102, the size of the vessel, bottle or canister 112 used with the bowl 102, the volume of water 114 held by the vessel 112, the preferences of the user of the apparatus 100, and the desired consistency of the smoke to be inhaled by the user of the apparatus 100, among other factors.

The perforated bottom portion 142 of the bowl 102, by and through the apertures 110, allows air to circulate between the bowl 102 and the vessel 112, when the bowl 102 in engaged with the opening of the vessel 112, as described in more detail below. The bowl 102 is preferably of a width and depth to permit at least a minimum quantity of leaves to be placed therein, and further comprises a generally open top surface for exposing the quantity of leaves placed in the bowl 102 to a flame, match or lighter. Some embodiments may include a reusable cap that attaches to the top of the bowl 102 so that the apparatus 100 can be packed with leaves and then covered with the cap to keep the leaves from falling out during travel. Some versions of the apparatus 100 can come pre-packed with leaves and covered with a top over the bowl so that the leaves do not need to be manually inserted by the user.

Figure 7:
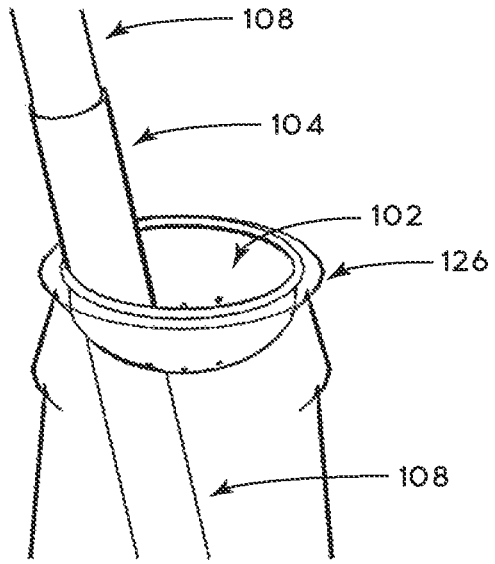
Figure 8:
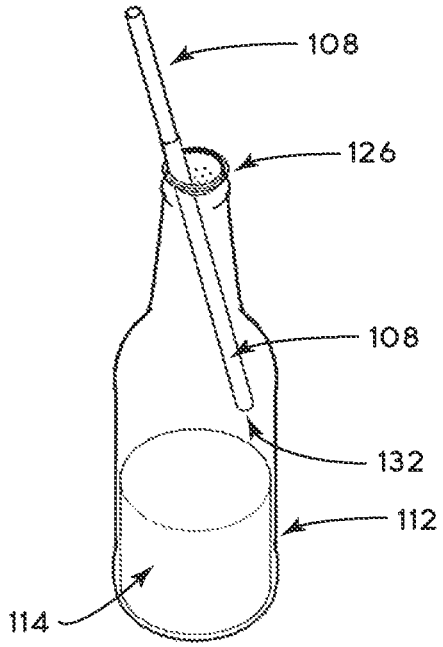
Figure 9:
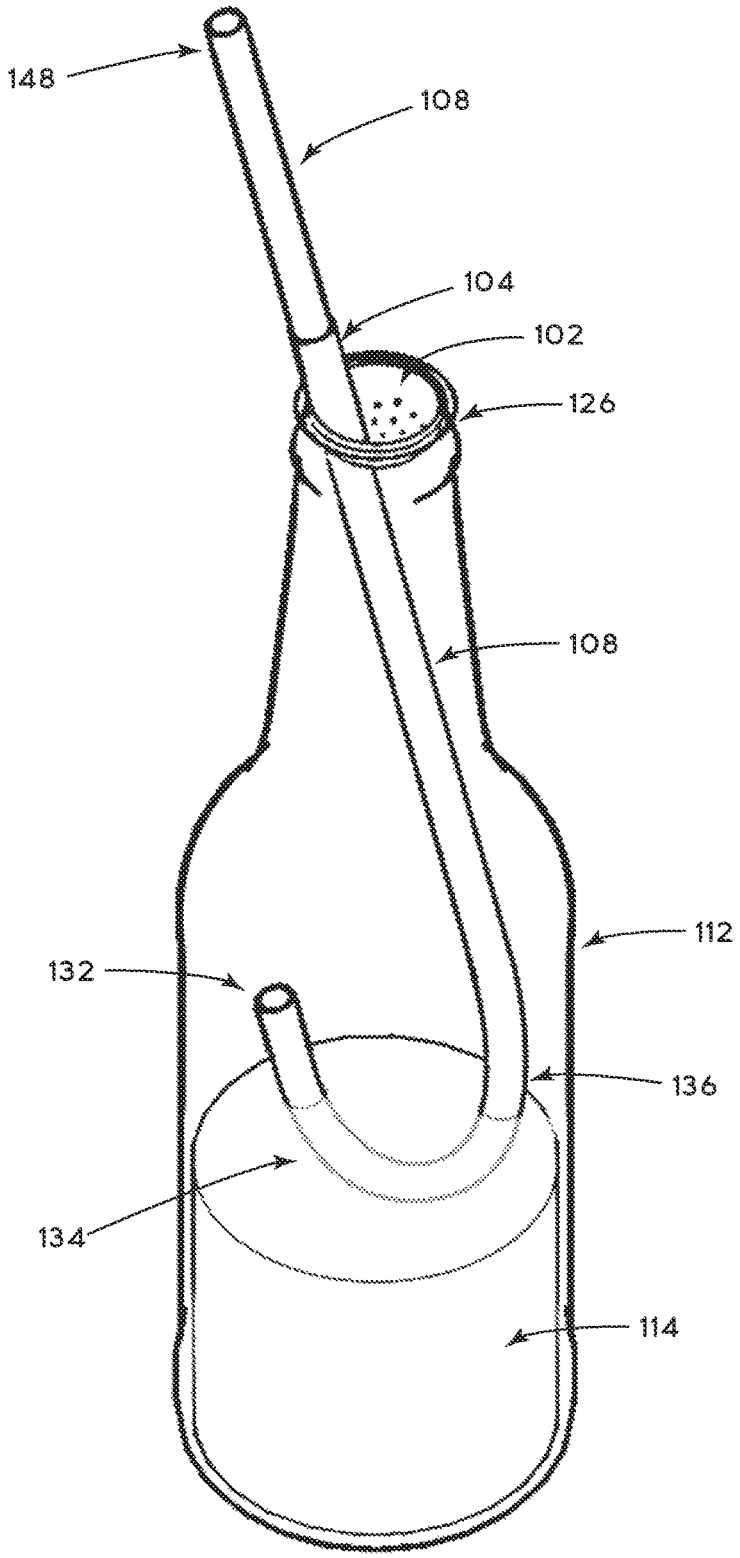

In certain embodiments, the apparatus 100 shown in FIG. 1 may be supplied with a straw 108, such as the embodiments shown in FIGS. 7-9. The straw 108 may be disposable, is preferably non-toxic and flame-resistant and made from, for example, non-toxic paper or hemp material. The straw 108 may also be used to enhance the inhalation of the user while the apparatus 100 and assembly is in use. The straw 108 may be substantially straight, as shown in FIGS. 7-8, or in other embodiments may be bendable and contain a lower portion 136 that is U shaped 134, wherein a lower portion 136 of the straw 108 is submerged in the water 114 contained in the vessel 112 as shown in FIG. 9. In this embodiment, as shown in FIG. 9, the smoke is not only cooled by the ambient temperature of the vessel 112 and surface water 114 (as with the straight straw described in FIGS. 7-8), but the smoke is also cooled by traveling through the water-cooled submerged lower portion 136 of the straw 108. When using a bendable straw, as described in FIG. 9, the straight end 148 would have to be inserted into the underside of the round opening 124 before the bowl 102 can be engaged with the vessel 112. In both embodiments described in FIGS. 1-8 and 9, the straw 108 extends down though the channel 106 and round opening 124 so that the lower end 132 of the straw 108 inside the vessel 112 is substantially fixed at a location above the water level of the vessel 112. When the straw 108 is inserted into the channel 106 of the straw element 104, a substantially air-tight connection is formed.

Figure 2:
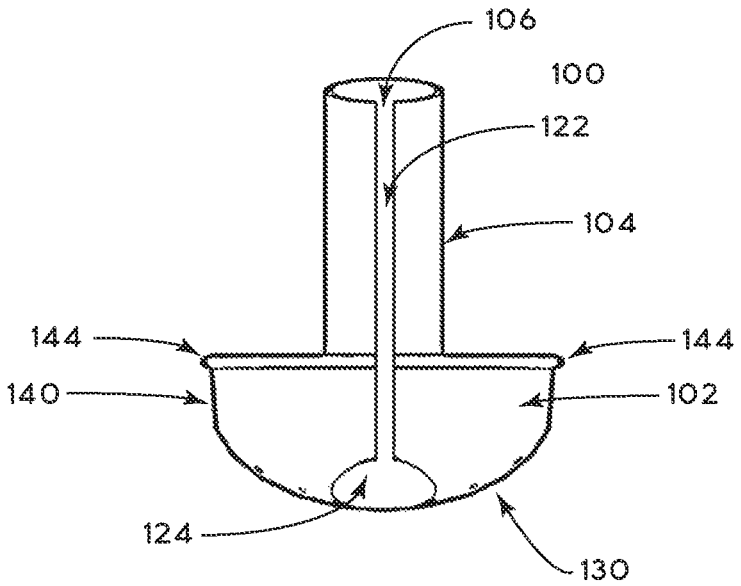

Referring to FIG. 2, the apparatus 100 is shown from the opposite angle as shown in FIG. 1. This elevation view depicts a small, narrow slit 122 extending vertically along the straw element 104 and at least a portion of the bowl 102. This narrow slit 122 may accommodate flexibility and adjustments to provide a more-secure fit of the bowl 102 into the vessel 112 opening in order to allow for miniscule size differences in inflexible container materials such as glass or metal. The slit 122 may also accommodate placement of the straw 108, such as the one described in the preceding paragraph, within the straw element 104 of the apparatus 100 shown in FIGS. 1-2. In certain embodiments, the bowl 102 and straw element 104 are comprised of a substantially rigid material, while in other embodiments they are comprised of a semi-rigid or even semi-flexible material. The more flexible the material, the more capable a user will be of expanding the straw element 104 to accommodate a larger straw 108. The round opening 124 at the lower portion 130 of the bowl 102 shown in FIG. 2 is for the lower end 132 of a straw 108 (not shown in FIG. 2) to be placed through the straw element 104 and bowl 102 of the apparatus 100 and enter the vessel 112 of the assembly (described in greater detail below).

Figure 3:
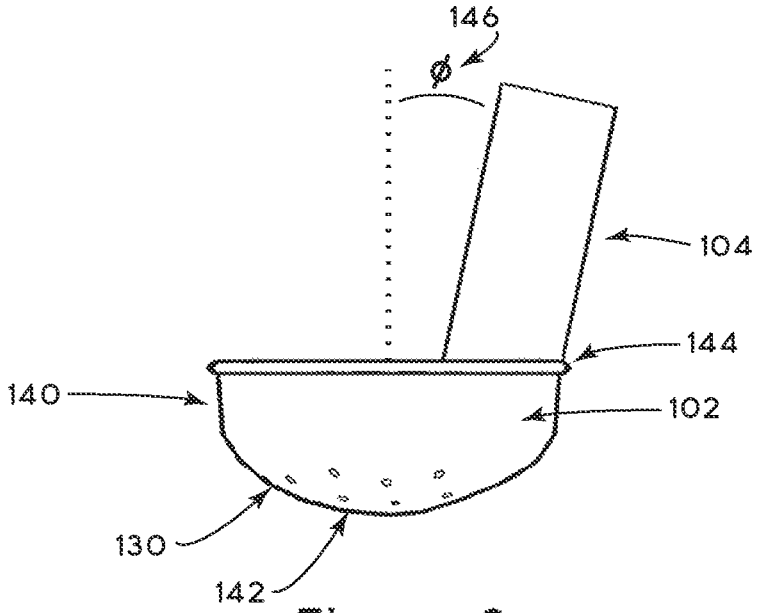
Figure 4:
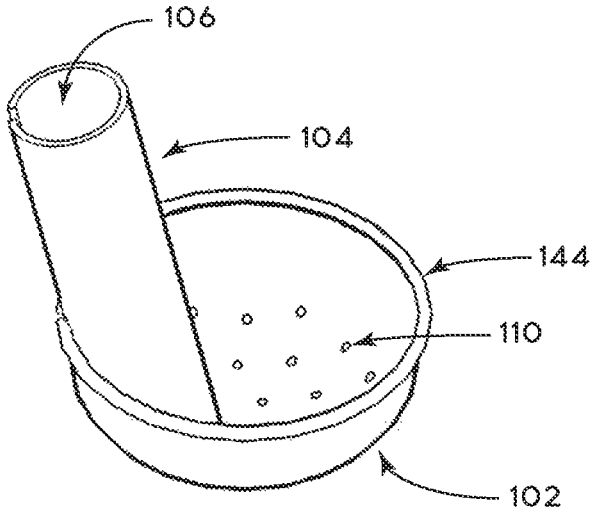
Figure 5:
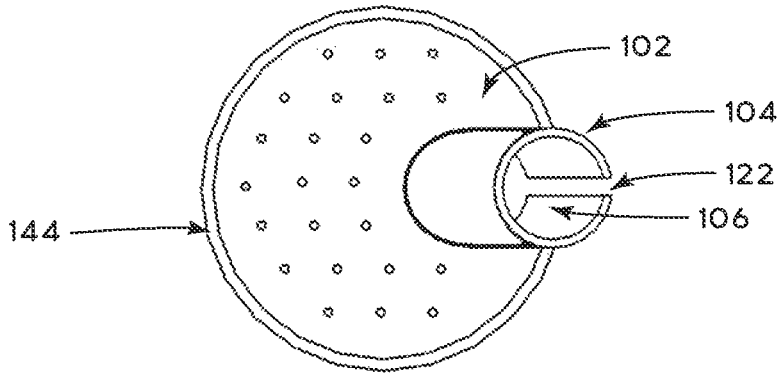
Figure 6:
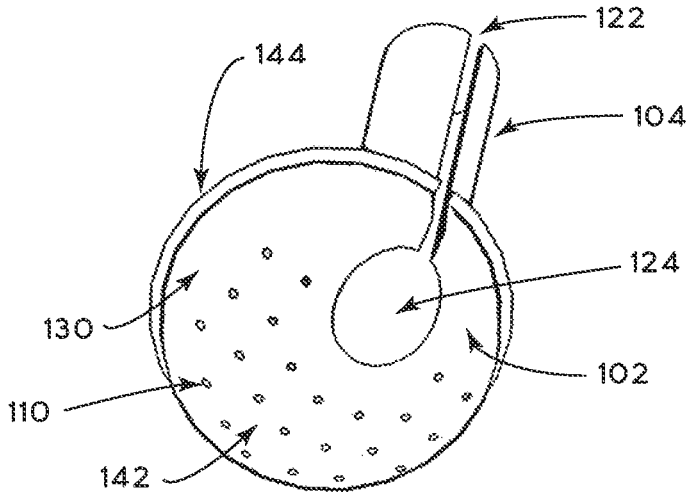

Referring now to FIGS. 3-6, the apparatus 100 is shown to contain the channel 106 and round opening 124, which are positioned at the side of the bowl 102, wherein the channel 106 extends away from the opening of the vessel 112 at angle $\ominus$ 146 from the vertical axis of the bowl 102, and wherein angle $\ominus$ 146 is approximately 30 degrees, as described in FIG. 3.

Referring now to FIGS. 7-8, the apparatus 100 is preferably used with a vessel 112, preferably a standard sized 12 ounce glass bottle, although in alternate embodiments may be used with other bottles, jars, canisters (including beer and soda cans) and other vessels. The apparatus 100 therefore is contemplated to be provided in a variety of sizes and configurations to accommodate the different sizes of openings provided with these types of vessels.

In use, the apparatus 100 is preferably placed on the top, open surface of the opening of a vessel 112, such as the one shown in FIGS. 7-9, so that the bowl 102 is releasably engageable with the opening of the vessel 112. The bowl 102 engages the vessel 112 by generally conforming to the circumference 126 of the opening of the vessel 112 thereby becoming substantially inserted inside the opening of the vessel 112, wherein the lip 144 of the bowl 102 is positioned generally wholly on top of the opening of the vessel 112. The bowl 102 when engaged with the opening of the vessel 112 creates a substantially air-tight connection between the bowl 102 and the vessel 112. The straw element 104 is preferably facing upwards, away from the opening of the vessel 112, and oriented so that the bowl's concave surface is also facing upward. This permits the user to place a quantity of leaves for smoking with the apparatus 100 in the bowl 102 and to have access to lighting that quantity of leaves without interfering with the straw element 104 or associated straw 108, or with the vessel 112 of the assembly. The vessel 112 is preferably filled with cold water 114, at least to a certain desired volume, but in no instance less than 10% of the entire volume of the vessel 112. In a preferred embodiment, approximately 20-40% of the vessel 112 is filled with water 114. In a most preferred embodiment, approximately 33% of the vessel 112 is filled with water 114. Although cold water is preferred, warm or even hot water will also suffice for use of the apparatus. However, in the most preferred embodiment, the water 114 added to the vessel 112 is cold water, ranging from 45 degrees to 70 degrees Fahrenheit. Although plastic bottles may be used, glass and ceramic bottles and canisters are preferred.

Figure 10:
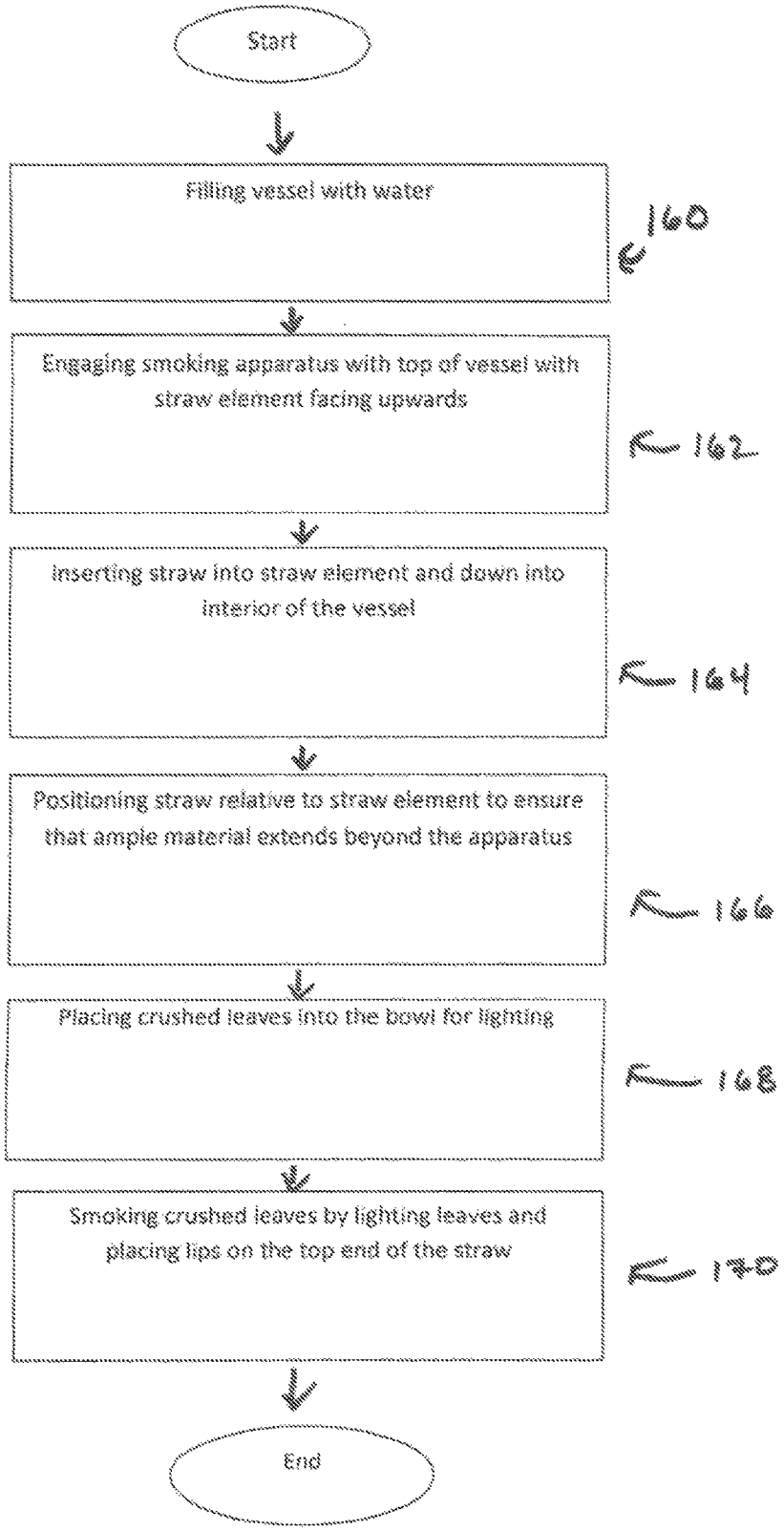

A method for using the smoking apparatus and assembly is also provided herein, as described in FIG. 10. In use, the user may fill the bottle to about ⅓ of the total volume with cold water 160. Next, the apparatus is placed onto the top of a bottle with the straw element facing up 162. A flame-resistant and preferably non-toxic straw is then inserted into the straw element and down into the interior of the bottle 164. In a preferred embodiment, the straw is inserted approximately half way down into the bottle. The bottom tip of the straw should not be touching or submerged into the water so the bottom straw opening rests in the open air portion of the bottle. Then the user checks the position of the straw relative to the straw element to ensure that ample material extends beyond the apparatus so that the straw may be placed on the lips of the user without the face of the user coming into close contact with the bowl, such that any flame or heated leaf material is at a safe distance from user's face 166.

Next, the user preferably places crushed plant leaves into the bowl for lighting and subsequent smoking 168. The user may light the leaves with one hand while simultaneously inhaling through the exposed straw. The smoke from the burnt leaves then travels down into the open air chamber of the bottle and up through the straw while being cooled by the water and the ambient temperature of the bottle (preferably glass). Excess debris from the plant leaves is then filtered down into the water portion of the bottle by falling directly down through the apertures (once burned to sufficiently small size to fit through the apertures). In this manner, cooled/filtered smoke is also trapped in the open air chamber, thus conserving it from going into the atmosphere and for further enjoyment by the user 170.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

The present inventions, in various embodiments, include components, methods, processes, systems and/or apparatuses substantially as depicted and described herein, including various embodiments, subcombinations, and subsets thereof. Those of skill in the art will understand how to make and use the present inventions after understanding the present disclosure. The present inventions, in various embodiments, include providing devices and processes in the absence of items not depicted and/or described herein or in various embodiments hereof, including in the absence of such items as may have been used in previous devices or processes, e.g., for improving performance, achieving ease and\or reducing cost of implementation.

Moreover, though the present disclosure has included descriptions of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An apparatus for use in a smoking assembly, comprising:

a generally concave bowl configured to be received by an opening of a vessel;

the generally concave bowl comprising an open top surface, a side wall, and a perforated bottom portion;

a substantially hollow element that protrudes from the open top of the bowl and above the opening of the vessel;

the apparatus further comprising a slit extending vertically along a length of the substantially hollow element and at least a portion of the bowl;

wherein the slit accommodates expansion or contraction of the apparatus to at least temporarily secure the apparatus to the vessel opening; and wherein the substantially hollow element is configured to receive a straw therethrough.

2. The apparatus of claim 1, wherein the apparatus is at least temporarily secured to the vessel by conforming an upper lip of the bowl to the opening of the vessel such that the perforated bottom portion extends into the opening of the vessel.

3. The apparatus of claim 2, wherein the apparatus is configured to be engaged with the opening of the vessel and create a substantially air-tight connection between the upper lip of the bowl and the vessel.

4. The apparatus of claim 2, wherein the perforated bottom portion of the bowl comprises a plurality of perforations and permits air to circulate between the concave surface of the bowl and the vessel.

5. The apparatus of claim 1, wherein the bowl is formed from stainless steel, titanium alloy, aluminum alloy, chromium alloy, carbon fiber, ABS plastic, polyurethane, polyethylene, photo-polymers, resins, particularly fiber-encased resinous materials rubber, latex, synthetic rubber, synthetic materials, polymers, natural material or a metal alloy.

6. The apparatus of claim 1 further comprising an opening located adjacent the bottom surface of the bowl and which permits a straw or tube to be placed through the substantially hollow element and into the vessel.

7. The apparatus of claim 6, wherein the straw or tube placed through the substantially hollow element provides a substantially air-tight connection between the straw or tube and the apparatus.

8. The apparatus of claim 7, wherein the substantially hollow element is configured to accommodate a variety of different sized straws or tubes, and wherein the slit may expand or contract to adjust to different sized straws or tubes.

9. The apparatus of claim 1, wherein the substantially hollow element is offset from a vertical centerline of the apparatus, and wherein the substantially hollow element extends away from the centerline at angle $\Theta$ from the vertical axis of the bowl, and wherein angle $\Theta$ is approximately 20-40 degrees.

10. The apparatus of claim 9 wherein the angle $\Theta$ is approximately 30 degrees.

11. The apparatus of claim 1, wherein the vessel is a glass bottle, canister or other fluid reservoir.

12. The apparatus of claim 1, wherein the vessel is a bottle comprised of material that can be easily cleaned, re-used or recycled.

13. The apparatus of claim 1, wherein the vessel is filled with water or other liquid at least to a certain desired volume, but no less than 10% of the entire volume of the vessel.

14. The apparatus of claim 1, wherein the vessel is filled with water or other liquid by approximately 33% of the entire volume of the vessel.

15. The apparatus of claim 13, wherein the water or other liquid added to the vessel ranges in temperature from about 45 degrees to about 70 degrees Fahrenheit.

16. The apparatus of claim 13, wherein a straw received by the apparatus may be inserted into the vessel, and wherein the straw is substantially straight and extends into the vessel so that the lower end of the straw inside the vessel is substantially fixed at a location above the water or other liquid level of the vessel.

17. The apparatus of claim 13, wherein a straw received by the apparatus comprises a lower portion that is U-shaped, wherein a section of the lower portion of the straw is submerged in the water or other liquid contained inside the vessel, and wherein the distal end of the U-shaped straw is adjustable to be positioned above the water or other liquid level of the vessel.

18. The apparatus of claim 1, wherein the straw received by the substantially hollow element is comprised of flame-resistant material.

19. The apparatus of claim 1, wherein the straw received by the substantially hollow element is formed by non-toxic paper or hemp material.

20. A method for smoking leaves comprising:

filling a vessel to approximately ⅓ of the total volume with cold water;

engaging a smoking apparatus with the top of the vessel with a straw element facing upward;

inserting a flame-resistant and non-toxic straw into the straw element and down into the interior of the vessel;

positioning the straw relative to the straw element to ensure that ample material extends beyond the apparatus so that the top end of the straw may be placed on the lips of the user without the face of the user coming into close contract with the bowl, such that any flame or heated leaf material is at a safe distance from the user's face;

placing crushed plant leaves into the bowl for lighting with a fire instigating device; and smoking the crushed plant leaves by lighting the plant leaves with a fire instigation device, wherein the user places his or her lips on the top end of the straw, wherein the smoke from the burnt leaves travels down in to the open air chamber of the vessel and up through the straw while being cooled by the water and the ambient temperature of the vessel, wherein excess debris from the burnt leaves is filtered down into the water portion of the vessel by falling directly through apertures located on the bottom of the smoking apparatus, and wherein cooled and filtered smoke from the burnt leaves is trapped in the open air chamber of the vessel thus conserving it from going up into the atmosphere and for further enjoyment by the user.

* * * * *